United States Patent [19]

Urs

[11] 4,428,295

[45] Jan. 31, 1984

[54] HIGH DENSITY SHOT

[75] Inventor: Venkataramaraj S. Urs, Godfrey, Ill.

[73] Assignee: Olin Corporation, Stamford, Conn.

[21] Appl. No.: 374,363

[22] Filed: May 3, 1982

[51] Int. Cl.[3] ..... B22F 3/00

[52] U.S. Cl. ..... 102/448; 102/501; 102/517; 419/48; 419/66; 428/570

[58] Field of Search ..... 102/448, 501, 517; 419/48, 66; 448/570

[56] References Cited

U.S. PATENT DOCUMENTS

| | | | |
|---|---|---|---|
| 2,113,279 | 4/1938 | Olin et al. | 102/501 |
| 3,888,636 | 6/1975 | Sezerzenie et al. | 102/501 |
| 3,987,730 | 10/1976 | Meadus et al. | 102/517 |
| 4,027,594 | 6/1977 | Olin et al. | 102/517 |
| 4,030,421 | 6/1977 | Litman | 102/516 |

*Primary Examiner*—Brooks H. Hunt.
*Attorney, Agent, or Firm*—Bruce E. Burdick

[57] ABSTRACT

A high density shot made of a cold-compacted mixture of at least two metal powders, a first one of such powders more dense than lead and a second one of such being flowable under compaction to serve as a binder. The shot has an extended range as compared to conventional lead shot.

6 Claims, No Drawings

HIGH DENSITY SHOT

This invention relates to shot for use in shotshells having extended range. The invention relates particularly to shot having a density higher than conventional lead shot.

"High density" as used below in reference to shot and powder means a density higher than metallic lead shot and metallic lead powder, respectively. High density shot is needed to extend the Effective Range, as defined below, of shotshells beyond that achieved with conventional shot, particularly in combat situations. The maximum Effective Range of existing shotshells using presently available triple ought lead shot is about 100 yards at currently acceptable recoil of five pound-seconds. Current M162 military shotshell cartridges with nine pellets of 00 buckshot are considered to have a maximum Effective Range of only 55 meters (60 yards). However, this Effective Range is less than desirable in combat situations where the opponent is further than 100 yards away. The combatant using ammunition with a greater Effective Range is at a definite advantage in longrange combat situations. Nevertheless, attempts to make high density shot have not proven successful. High density materials, such as tungsten, osmium and iridium have very high melting points and are too hard to fabricate by mechanical forming. The high melting point makes it impractical to form shot from a molten metal as is done with lead shot dropped from a conventional shot tower. One method to form high density shot would seem to be the compaction of the metal powder with an adhesive. However, the adhesives which are generally available have such a low density that effective amounts would lower the overall density of the composite shot to be at or below the density of lead and, therefore, fail to produce an extended range shot. A dense low-melting metal such as lead does not wet metal particles of tungsten, osmium and iridium and, therefore, a suspension of the particles of tungsten, osmium and iridium in molten lead is unstable and the tungsten, osmium and iridium particles sink to the bottom of the molten lead, thus producing a non-uniform casting composition.

A solution to these problems is provided by the present invention. The present invention provides a high density shot which consists essentially of a cold-compacted mixture of at least two metal powders, a first one of such powders being more dense than lead and a second one of such powders being flowable under cold compaction to serve as a binder. The invention also provides a process for making high density shot in which such a powder mixture is cold compacted at a pressure of at least 20,000 pounds per square inch. The second metal powder is preferably lead since lead metal is soft and flows around the harder tungsten, osmium or iridium powder particles when subjected to pressures over 20,000 psi and binds the tungsten, osmium or iridium particles together into a strong composite shot which stays intact. This composite shot has been found to spread out into a disc when heavy weights are dropped on it rather than disintegrating into particles. Sintering is not necessary and has actually been found to have an adverse effect.

"Cold compaction" as used herein means compaction at a temperature below the melting point of the metals being compacted. "Effective Range" as used herein means the maximum range at which a load of shot fired at less than 5 pounds seconds recoil energy will retain both a total kinetic energy of at least 954 foot pounds in a five-foot diameter circle and a total kinetic energy of at least 1240 foot pounds per square inch of total frontal area of the shot.

The shot of the invention can be produced by mechanically mixing metal particles of hard, high density metals such as tungsten, osmium and iridium, with lead particles and then compacting the resultant mixture in a spherical mold at pressures over 20,000 psi. Preferably, a multi-cavity spherical mold would be used in order to achieve practical product rates. A shot consisting of 50 percent by weight of tungsten and 50 percent by weight of lead made by the high pressure compaction process of the invention has a calculated density of 14.25 grams per cubic centimeter, and a measured density of 13.9 grams per cubic centimeter. A 60 percent by weight tungsten and 40 percent by weight lead mixture has high pressure compaction yields shot of a calculated density of 15.04 grams per cubic centimeter and a measured density of 14.3 grams per cubic centimeter. A 70 percent/30 percent by weight tungsten/lead mixture results after high pressure compaction in shot with a calculated density of 18.3 grams per cubic centimeter and measured density of 18.0 grams per cubic centimeter.

High density shot made by this high pressure cold compaction process has been found to retain a larger percentage of the muzzle velocity and energy at varying ranges than conventional lead shot when fired from an otherwise conventional shotshell in a conventional shotgun. The following example illustrates this:

EXAMPLE

A load of 8 pellets of conventional lead shot with a diameter of 0.36 inches (000 buckshot) and a density of 11.0 grams per cubic centimeter was loaded in a conventional 2 ¾ inch 12 gauge shotshell and fired at a muzzle velocity of 1640 feet per second, thus giving a muzzle energy of 3250 foot pounds. For comparison purposes, a shot made according to the invention was tested ballistically. The shot consisted of 50 percent by weight of tungsten and 50 percent by weight lead made by the high pressure cold compaction process of the invention at ambient temperature and a 20,000 psi compaction pressure in an arbor press using a split spherical mold with a 0.36 inch diameter mold cavity to produce compacted shot with a measured density of 13.9 grams per cubic centimeter was tested. The shot was formed into spheres with a diameter of 0.36 inches and 8 pellets were loaded into a compression-formed 2 ¾ inch 12 gauge shotshell. This shot load was fired at a muzzle velocity of 1440 feet per second thus giving a muzzle energy of 3163 foot pounds. The conventional lead shot had an effective range of 100 yards while the high density shot of the invention had an effective range of 140 yards. The high density shot thus had an effective range 40 percent longer than the maximum effective range of the conventional lead shot and the results of this test are found in the table below:

| Shot | | | | Muzzle | Muzzle | Range with |
|---|---|---|---|---|---|---|
| Material | Density | Diameter | No. in Shotshell | Velocity (fps) | Energy (ft-lbs) | 1240 ft.lb. Retained Energy |
| Lead | 11.0 | .36" | 8 | 1640 | 3250 | 100 Yards |
| 50/50 Tungsten & Lead | 13.9 | .36" | 8 | 1440 | 3163 | 140 Yards |

What is claimed is:

1. High density shot which consists essentially of an unsintered cold-compacted mixture of at least two metal powders, a first one of such powders being more dense than lead and a second one of such powders being flowable under compaction to serve as a binder.

2. The shot of claim 1 wherein said first powder is tungsten.

3. The shot of claim 1 wherein said second powder is lead.

4. The shot of claim 1 wherein the volume percentage of said second powder is within the range of from about 10 percent up to about 99 percent and a volume percentage of said first powder is within the range of from about 1 percent up to about 90 percent.

5. A process for making high density shot which comprises the steps of:

(a) Mechanically mixing at least two metal powders, a first one such being more dense than lead and a second one of such powders being flowable under compaction to serve as a binder;

(b) Compacting the resultant mixture in a spherical mold at pressures of at least 10,000 psi at temperatures below the melting point of the second powder thereby to form the high density shot.

6. The process of claim 5 wherein the compaction pressure is at least 20,000 psi.

* * * * *